United States Patent [19]

Bryant, Jr. et al.

[11] 4,248,251

[45] Feb. 3, 1981

[54] TOBACCO COMPOSITION

[75] Inventors: Herman G. Bryant, Jr., Bahama; Vello Norman, Raleigh, both of N.C.

[73] Assignee: Liggett Group Inc., Montvale, N.J.

[21] Appl. No.: 13,576

[22] Filed: Feb. 21, 1979

Related U.S. Application Data

[63] Continuation-in-part of Ser. No. 721,142, Sep. 7, 1976, abandoned, which is a continuation-in-part of Ser. No. 458,355, Apr. 5, 1974, abandoned.

[51] Int. Cl.[3] ..... A24B 15/28; A24B 15/30; A24B 15/42

[52] U.S. Cl. ..... 131/17 R

[58] Field of Search ..... 131/2, 17, 15, 140 B, 131/9

[56] References Cited

U.S. PATENT DOCUMENTS

| | | | |
|---|---|---|---|
| 2,902,998 | 9/1959 | Durandeaux | 131/9 |
| 3,474,792 | 10/1969 | Miller et al. | 131/17 R |
| 3,572,348 | 3/1971 | Morman et al. | 131/17 R |

FOREIGN PATENT DOCUMENTS

| | | | |
|---|---|---|---|
| 1219880 | 12/1959 | France | 131/140 B |
| 841074 | 7/1960 | United Kingdom | 131/17 R |

OTHER PUBLICATIONS

*Tobacco and Tobacco Smoke* by Wynder et al., p. 526, published by Academic Press 1967, N.Y., N.Y.

*Primary Examiner*—V. Millin
*Attorney, Agent, or Firm*—J. Bowen Ross, Jr.

[57] ABSTRACT

The concentration of polycyclic aromatic hydrocarbons in tobacco smoke is reduced by incorporating palladium, either in metallic form or as a salt, and an inorganic nitric oxide generating compound into tobacco.

3 Claims, No Drawings

TOBACCO COMPOSITION

This application is a continuation-in-part of U.S. Patent application Ser. No. 721,142, filed Sept. 7, 1976 now abandoned, which in turn is a continuation-in-part of abandoned U.S. Patent application Ser. No. 458,355, filed Apr. 5, 1974 now abandoned.

This invention relates to smoking compositions containing tobacco and having associated therewith a combination of a catalytic agent and a material capable of releasing nitric oxide under smoking conditions. More particularly, it relates to such compositions wherein the catalytic agent is palladium, either in metallic form or as a salt, and the nitric oxide releasing additive is an inorganic nitrate and or nitrite salt. Further this invention relates to such compositions wherein the catalytic agent is palladium and the nitric oxide releasing component is naturally present in the tobacco.

BACKGROUND

Observations of the mechanism of combustion in tobacco compositions such as cigarettes, indicate that the smoke components responsible for biological activity of smoke as evaluated on experimental animals are formed in the pyrolysis zone of the cigarette cone. The literature suggests that much of this biological activity, observed in connection with the testing of cigarette smoke condensate on standard experimental animals according to conventional protocol, resides in the neutral smoke fraction and more specifically within the subfraction which contains the polycyclic aromatic hydrocarbons (PCAH).

There is a body of opinion that it would be desirable to decrease the levels of PCAH compounds in cigarette smoke and this has led to a substantial amount of research aimed at reducing the proportion of such compounds in cigarette smoke.

It has been postulated that there are several pathways by which the tobacco components are converted into polycyclic aromatic hydrocarbons. One major route is the thermal degradation of various organic materials such as e.g., cellulose into insaturated free radical species consisting of two, four or five carbon atoms and, in case of the longer fragments, of conjugated double bonds. The free radical species subsequently participate in the pyrogenesis of aromatic ring structures, the two and four carbon fragments giving rise to unsubstituted PCAH and the five carbon branched structure giving rise to methyl substituted PCAH. Another major route is the formation of PCAH from pre-extant skeletal structures already present in tobacco such as steroids. In the latter case only minor thermally induced modifications are necessary to produce PCAH molecules. Many other routes, such as ring closures of sidechains are possible.

Since the possible pathways of PCAH formation are widely different, it is highly unlikely that any one catalytic agent or other additive would interfere with all of the different formation processes. For instance, in U.S. Pat. No. 4,177,822 by H. G. Bryant, Jr., T. Blair Williams and V. Norman, there is disclosed a smoking composition comprising tobacco in association with finely divided metallic palladium or palladium salt. This material is disclosed to result in a tobacco composition wherein the polycyclic aromatic hydrocarbon (PCAH) content arising from the pyrolytic reactions within this composition is substantially reduced when compared to a control cigarette. It has now been found, however, that palladium catalyst alone, while apparently very efficient in eliminating the production of PCAH by some of the pyrosynthetic routes, has its limitations and does not affect all of the pathways.

The addition of nitrates and nitrites to tobacco has been previously described in various patents and publications. Thus, French Patent No. 1,180,320 teaches the addition of unspecified amounts of nitrites to tobacco and cigarette paper to reduce the PCAH yield and U.S. Pat. No. 3,121,433 describes the addition of potassium nitrate to reconstituted tobacco sheet to improve its burning characteristics. U.S. Pat. No. 3,380,458 teaches the addition of 5.5 to 10% of potassium and sodium nitrates to tobacco ($NaNO_3$: 0.91–1.65% nitrate nitrogen, $KNO_3$: 0.76–1.39% nitrate nitrogen) and it discloses a reduction in cigarette "tar" yield which is caused by the concomitant increased burn rate of the cigarette.

Bentley and Burgan (*Analyst* 85, 727–730, 1960) describe the addition of various nitrates to tobacco in an attempt to reduce the yield of 3,4-benzopyrene. They achieved a reduction only with copper and potassium nitrates and increases with lead, silver and zinc nitrates.

Wynder and Hoffman (*Acta Pathol. Microbiol, Scand.* 52, 119–132, 1961, and *Deutch. Med. Wochenschr.* 88, 623–628, 1963) using cigarettes treated with 5% copper nitrate (0.50% nitrate nitrogen) confirmed Bentley and Burgan's finding that copper nitrate reduced the 3,4-benzopyrene yield of cigarettes. Hoffman and Wynder also demonstrated (*Cancer Res.* 27, 172–174, 1967) that the addition of 8.3% of sodium nitrate (1.37% nitrate nitrogen) resulted in a significant reduction of cigarette 3,4-benzopyrene yield as well as in a reduction of the biological activity of the smoke condensate. Pyriki et. al. (*Ber. Inst. Tabakforsch. Dresden,* 12, 37–55, 1965), on the other hand, have shown that the addition of 4% of potassium nitrate (0.55% nitrate nitrogen) increased the level of 3,4-benzopyrene in cigarette smoke by 40%.

The addition of platinum group metals to tobacco compositions to lower the concentration of benzopyrene in tobacco smoke is disclosed in British Pat. No. 841,074, issued July 13, 1960, to Johnson Matthey and Co. Ltd. The examples of the British reference show only the addition of platinum to tobacco and makes no reference to the addition of inorganic nitrate salts to the tobacco in combination with the platinum.

While most of the past investigators have expressed their research results in terms of the effect of the additive on 3,4-benzopyrene yield in cigarette smoke, it is now becoming widely recognized that this compound probably plays at most only a minor role in the biological activity of tobacco smoke condensate. It is also now recognized that the yield of 3,4-benzopyrene, which is a very minor constituent of the PCAH fraction, is not necessary a reliable indicator of the additives' effect on the bulk of the PCAH.

It has been postulated that the effect of nitrates on the combination of cigarette smoke stems from two properties of nitrates: (a) their capacity to function as oxidants, and (b) their capacity to form the unpaired electron species, nitric oxide, in the pyrolysis zone of the cigarette that acts as a free radical scavenger. Provided a sufficiently high level is added, all nitrates tend to lower the PCAH yield of cigarettes to some degree, but depending on the particular cation, not necessarily the concentration of PCAH in the smoke condensate, as indicated in the Pyriki et. al. article discussed above.

DESCRIPTION OF THE INVENTION

It has now been found that the concentration of the PCAH fraction normally found in the smoke of a natural leaf smoking tobacco can be substantially reduced without adverse organoleptic effect on tobacco smoke by incorporating both palladium, in metallic or salt form, and an inorganic salt of nitric or nitrous acid. It has been further discovered that the amount of added inorganic nitrate or nitrite salt required to lower the concentration PCAH in tobacco smoke can be lowered by the use of tobaccos containing a high concentration of native nitrate nitrogen. The present invention involves the application of these surprising discoveries to cigarettes, cigars, pipe tobacco and other smoking tobacco compositions.

DETAILED DESCRIPTION OF THE INVENTION

In accordance with one embodiment of the present invention the concentration of PCAH is substantially reduced without adverse organoleptic effect on tobacco smoke by incorporating in tobacco both palladium, in metallic or salt form, and a nitrate or nitrite salt of a metal selected from Groups Ia, Ib, IIa, IIb, IIIa, IIIb, IVa, IVb, Va, Vb, and the transition metals of the Periodic Table of Elements.

Palladium may be incorporated into the tobacco compositions in finely divided metallic form, for example palladium black, and/or in the form of a salt which is decomposable "in situ", preferably by heat, into metallic palladium. Water-soluble palladium salts are preferred because they are readily incorporated into and distributed throughout the tobacco composition. Illustrative examples of suitable palladium salts include simple salts such as palladium nitrate, palladium halides such as palladium chloride, diammine complexes such as palladous dichlorodiammine ($Pd(NH_3)_2Cl_2$), and palladate salts, especially ammonium salts such as ammonium tetrachloropalladate and ammonium hexachloropalladate. One form of palladium which has been found to be particularly effective in combination with tobacco to provide the smoking composition of this invention is ammonium hexachloropalladate, $(NH_4)_2PdCl_6$, (Research Organic-Inorganic Chemicals Corp.), 99.5% pure.

The catalytic amount of palladium associated with the tobacco in the smoking composition is in the range of between about 0.001 percent to about 1 percent by weight of the tobacco used to prepare the smoking composition. Although the reduced yield of polycyclic compounds arising from pyrolytic reactions of the composition have been achieved at these levels, it has been found that the best results are obtained when the palladium is in the preferred range of from about 0.01 percent to about 0.1 percent, most preferably from about 0.03 percent to about 0.07 percent, based upon the weight of the tobacco.

The nitrates which are employed in accordance with the present invention are the nitrate salts of metals of Groups Ia, Ib, IIa, IIb, IIIa, IIIb, IVa, IVb, Va, Vb, and the transition metals of the Periodic Table. The particular nitrate salt chosen for use in the practice of the present invention is one which is deemed to be non-toxic when present in the smoking compositions of the present invention.

Illustrative of the various nitrate salts which are suitable for use, from a toxicity standpoint, in the practice of the present invention are the nitrates of lithium, sodium, potassium, rubidium, cesium, magnesium, calcium, strontium, yttrium, lanthanum, cerium, neodymium, samarium, europium, gadolinium, turbium, dysprosium, erbium, scandium, manganese, iron, rhodium, palladium, copper, zinc,, aluminum, gallium, tin, bismuth, hydrates thereof and mixtures thereof. Preferably, the nitrate salt is an alkali or alkaline earth metal nitrate. More preferably, the nitrate is selected from the group of calcium, magnesium, and zinc with magnesium nitrate being the most preferred salt. A magnesium nitrate which has been particularly effective in combination with palladium and tobacco to provide the smoking composition of this invention is A.C.S. grade $Mg(NO_3)_2.6H_2O$ which contains (on a weight basis) less than about 0.0005% chloride ion, 0.005% sulfate ion and 0.0004% heavy metals (calculated as lead).

In addition to the nitrate salt other metal salts capable of releasing nitric oxide are useful in the practice of the present invention. Illustrative of these are the various inorganic nitrite salts such as lithium nitrite, calcium nitrite, hydrated salts thereof and mixtures thereof.

Using the generally accepted standard toxicological procedures described in the disclosures of *Industrial Toxicology,* 3rd Edition, Hardy et. al., Acton Mass., Publishing Sciences Group Inc., 1974; *Merck Index, 8th Edition,* Rahway, N.J., Merck & Co., Inc. 1968; *Sax Dangerous Properties of Industrial Materials, 4th Edition,* New York, Van Nostrand Reinhold Co., prior art (5–10%), impart a disagreeable taste to the main stream of smoke and an obnoxious odor to the side stream aroma, thereby making the cigarette unacceptable from the point of view of a palatable cigarette. Thus, nitrate salts, when used alone in tobacco, have not proven to be universal eliminators of PCAH, particularly at levels compatible with acceptable taste and smell of cigarette smoke. Thus, when these nitrate salts are used in accordance with the practice of the present invention, i.e., in the presence of palladium, the amount of nitrate required to decrease the PCAH of the tobacco smoke is lowered significantly thereby allowing for the production of cigarettes that are most desirable from a taste and smell standpoint, yet have a significant reduction in the PCAH content of their tobacco smoke.

As noted above, another embodiment of the present invention comprises the addition of palladium, in metallic or salt form, to smoking tobaccos which naturally contain relatively high concentrations of nitrate in the tobacco. Illustrative of the tobaccos possessing a high concentration of native nitrate and which are useful in the practice of the present invention are the various Burley tobaccos, such as those that originate in Germany, Japan and the United States; selected Turkish tobaccos, such as those that originate in the USSR and Bulgaria; the Maryland tobaccos; and blends thereof with or without the various grades of the Bright tobaccos.

Another means of increasing the native nitrate content of the tobacco blend involves the use of the processed lower lug portions of the tobacco plant. For instance increasing the content of tobacco Burley stems in the final blend has been found to be especially effective in increasing the native nitrate content of the finished blend.

A list of the various tobaccos and their native nitrate content can be found in the *Tobacco and Tobacco Smoke Studies in Experimental Carcinogenesis,* by Ernest L. Wynder and Dietrich Hoffman, Academic Press 1967, the disclosure at pages 453-458 of which is incorporated herein by reference.

In the practice of the present invention, the proportion of nitrate associated with palladium and tobacco in the smoking composition is below 0.8% (calculated as nitrate nitrogen), and preferably is in the range of from about 0.25 weight percent to about 0.75 weight percent, calculated as native or the sum of native plus added nitrate nitrogen, of the total tobacco or tobacco blend. Although the amount of reduction of PCAH yield that is due to the nitrate can be increased as the level of nitrate is increased, the taste and aroma of smoke becomes progressively more obnoxious as the nitrate level is increased. Hence, in combination with palladium, we prefer to operate in the range of from about 0.50 to about 0.80 percent total nitrate nitrogen whether in the form of added nitrate salt or native to the tobacco. These same concentrations apply when the inorganic nitric oxide generating compound is an inorganic nitrite salt.

In addition the present invention contemplates the use of an added inorganic nitrate or nitrite salt, or naturally occuring native nitrate, or mixtures thereof in combination with palladium in a tobacco composition.

In those instances wherein the entire or predominant portion of the nitrate component of the tobacco compositions of the present invention are naturally occuring in the tobaccos, i.e. native nitrate, it has been found that the addition of a water soluble magnesium salt may be desirable. The magnesium salt can be inorganic or organic provided it is non-toxic. Illustrative of these salts are magnesium oxalate, magnesium citrate, magnesium chloride, etc. The magnesium is added in amounts sufficient to adjust the concentration of magnesium in the final tobacco blend in the range of from about 0.5 to about 1.0 weight percent.

The incorporation of the additives of the present invention may take place at any time prior to the final packaging of the tobacco product. In the case of cigarette tobacco they may be incorporated before or after blending of the various tobaccos if, in fact, blended tobacco is employed. Further the additives should be well dispersed throughout the treated tobacco and may be applied to one or all of the blend constituents.

The additives should be well dispersed throughout the tobacco so that they will be uniformly effective during the entire period during which the composition is smoked. Furthermore, it is important to ensure that the dispersion effectively contacts a maximum volume of nascent smoke. Since the catalytic activity of the palladium is most likely a surface phenomenon, the greatest likelihood of maximum contact between the nascent smoke and the palladium is obtained when the area/volume ratio of the palladium particles is maximized for a given weight of palladium. For this reason, if the palladium is applied as metallic palladium black its particle size should preferably be smaller than 100 U.S. mesh. Water-soluble palladium salts such as hexachloropalladate, tetrachloropalladates, nitrate, chlorides or diamine complexes have the advantage that they can be applied as a dilute solution which facilitates the achievement of good dispersion throughout the tobacco matrix.

Preliminary investigative work indicates that substantially all of the palladium when added in salt form is completely reduced to palladium metal by the time it is dispersed in the tobacco blend and prior to its manufacture into the finished smoking article.

The calcium, magnesium, and zinc nitrates are very soluble in water and can be applied as a relatively concentrated solution which avoids the excessive wetting of tobacco and yet assures good distribution throughout the tobacco matrix.

We have found that the combination of palladium and a nitrate compound is most efficiently applied in a conventional casing solution such as one comprising glycerin, propylene glycol and sugars to which a solution of ammonium hexachloropalladate and a sufficient amount of water to solubilize the requisite amount of nitrate compound have been added. Such a solution can be conveniently atomized on uncut tobacco strip, or applied by conventional casing apparatus.

In those instances where the palladium starting material is a water soluble palladium salt it has been found desirable to apply the palladium and its carrier medium after the "soluble palladium" in the carrier medium has been reduced to not more than 5 percent of the total palladium. The carrier medium in most instances will be the casing mixture. The insolubilization of the palladium in an aqueous medium is achieved by the addition of a reducing agent capable of reducing the soluble palladium ions to "insoluble palladium". This insolubilization of the palladium is best achieved at temperatures of from about 50° C. to about 90° C. in a solution having a pH of no more than 3 and by the use of a sugar and/or a polyhydroxy compound as the reducing agent as described in an application by *Herman G. Bryant, Jr.*, et. al., filed Feb. 21, 1979, Ser. No. 013,575 the disclosure of which is incorporated herein by reference.

"Soluble palladium" as used herein can be defined as palladium in an aqueous mixture which when the mixture is diluted with water and filtered through a membrane filter with 0.45$\mu$ pores, appears in the filtrate. The palladium which is retained on the filter is defined as "insoluble palladium". The chemical form of this "insoluble palladium" has been found to be predominantly, if not completely, metallic palladium. The chemical form of the "soluble palladium" is considered to be essentially all ionic, based on available evidence. Though the precise forms of soluble and insoluble palladium have not been conclusively established, the present invention is intended to extend to "insoluble palladium" formed in the manner described, regardless of the precise chemical and physical form of the palladium.

As noted above, to achieve practical rates of conversion of the formation of insoluble palladium the casing solution or other aqueous solution or carrier medium of the palladium is heated at elevated temperatures. However, as the temperature increases, the insoluble palladium tends to form agglomerates of insoluble palladium, which tend to have reduced activity. The formation of such agglomerates can be inhibited through the inclusion of protective colloids such as gelatin, gums such as gum tragacanth, and the like, in amounts of up to about 1 weight percent, and preferably from about 0.2 to about 0.6 weight percent. However, at temperatures in excess of about 90° C., the formation of the relatively inactive palladium agglomerates becomes excessive. Furthermore, extended heating at elevated temperatures can cause breakdown of sugars or other compounds present in the aqueous solution, forming decomposition products which have an adverse effect on the taste of tobacco smoke. In general, then, temperatures in the range of from about 50° C. to about 85° C. are employed, with temperatures of from about 70° C. to about 80° C. being preferred. A suitable method for the incorporation of these protective colloids is described in application Ser. No. 013,574, Feb. 21, 1979, by R. G. Honeycut, J. F. Bullock, and H. G. Bryant, Jr., the disclosure of which is incorporated herein by reference.

Palladium black can be applied on tobacco in the form of a suspension in casing or water or in dry powder form containing the requisite amount of palladium by any convenient means such as atomization or dusting.

When palladium black is used, a convenient method of application of the additive to the tobacco is to dry blend the palladium, ground tobacco, a fibrous material and a binder. Dry blending, as in a conventional double cone blender effectively distributes the palladium over the surface of the tobacco including the pores within the tobacco surface which are large enough to accept the palladium particles.

When required, dry blending is followed by wet mixing with water and casing materials in proportions sufficient to provide the resulting mixture with the appropriate consistency for conventional reconstituted tobacco sheet manufacturing operations. The sheet is then cut into strips and a solution of nitrate compound in water is applied to the strips. This is followed by a drying step if the tobacco moisture level needs to be adjusted. This material can be used in cigarette manufacture as such or it can be blended in any desired proportion with regular tobacco.

The fibrous material which is a constituent of the dry blend can be, for example, cellulose or fibrous tobacco stem material. The binder portion of the dry blend may be sodium carboxymethyl cellulose, or a natural gum such as guar gum. The casing materials used in the wet mixing step are usually glycerin and propylene glycol. Of course, any other known fibrous material, binder or casing materials known to be useful in combination with tobacco products can be used in combination with or in place of those herein set forth.

The weight proportions of the additives described above for use in reconstituted tobacco sheets are within the following approximate weight ranges. The proportions shown are within the usual range required to provide useful tobacco products.

| MATERIAL | WEIGHT % |
|---|---|
| Fibrous | 4–8 |
| Binder | 1–20 |
| Casing | about 3–9 |
| Comprising: | |
| (a) glycerin | 4–6 |
| (b) propylene glycol | 0.5–2 |
| Tobacco | balance to 100% |

The smoking composition may be further processed and formed into any desired shape or used loosely e.g., cigars, cigarettes, and pipe tobacco in a manner well-known to those skilled in the tobacco art.

Alternatively, solutions of soluble palladium compounds, suspensions of palladium black in casing or water or powder mixtures can be dispersed by atomization or other convenient means on reconstituted tobaccos manufactured by methods other than the one described above or on synthetic tobacco substituted materials.

A further understanding of the invention will be had from a consideration of the following examples that may be used in actual commercial practice and are set forth to be illustrative of certain preferred embodiments and not to limit the scope of the present invention.

EXAMPLE I

A 0.77-pound portion of ammonium hexachloropalladate was dissolved in the minimum amount of water necessary and the solution was added to a mixture of sugar-glycerin-propylene glycol-water casing solution. A 18.94-pound portion of magnesium nitrate hexahydrate was dissolved in this mixture and sprayed in a conventional casing applicator onto 222 pounds of uncut strip tobacco blend. The treated tobacco was blended with 63.0 pounds of reconstituted tobacco sheet and 15.0 pounds of stems. The resulting blend was cut at 32 cuts per inch (Sample 1). Blends containing only the palladium (Sample 2) and only the magnesium nitrate (Sample 3) as well as a control blend containing neither additive were prepared in a similar manner.

Each of the three samples and the control blend were pyrolyzed in a special pyrolysis reactor consisting of a steel cylinder about 4 inches in diameter and 5 inches along with an annular space at the central perimeter covered with a stainless steel screen. Cut tobacco was packed into this reactor at densities similar to cigarette densities and the tobacco was lit at the exposed perimeter. The burning tobacco itself thus produced the necessary heat for pyrolysis and the reactor closely approximated on a large scale the conditions extant in a burning cigarette cone. The combustion and pyrolysis products were pumped out through a small tube positioned concentrically with the cylinder and the dry solids in the smoke were analyzed for PCAH content. The concentrations of PCAH from the test tobaccos, as a percent of the concentration of PCAH from the control tobacco are tabulated as follows for a typical run:

| SAMPLE | ADDITIVE, WEIGHT % | | CONCENTRATION OF PCAH RELATIVE TO CONTROL | |
|---|---|---|---|---|
| | $(NH_4)_2PdCl_6$* | $Mg(NO_3)_2$** | WEIGHT BASIS | IR ANALYSIS*** |
| Control | — | — | 100 | 100 |
| 1 | 0.06 | 0.55 | 50 | 50 |
| 2 | 0.06 | — | 60 | 59 |
| 3 | — | 0.55 | 78 | 78 |

*As palladium
**As nitrate nitrogen
***From infrared spectral absorption in the region of aromatic C—H bonding vibrations. (11.9–14.0)

EXAMPLE II

A 0.64-gram portion of ammonium tetrachloropalladate was dissolved in 100 cc of water and added to 56.6 g of glycerine-sugar-propylene glycol casing solution. A 27.5-gram portion of magnesium nitrate hexahydrate was dissolved in the casing solution and the mixture was sprayed onto 400 g of cut strip blend (32 cuts per inch) (Sample 4). A blend containing only the $(NH_4)_2PdCl_4$ was prepared in a similar manner (Sample 5).

These samples were tested as described in Example I, and the data obtained are tabulated for a typical run. Data for Sample 3 and the control of Example I are included for purposes of comparison.

| SAMPLE | ADDITIVE, WEIGHT % $(NH_4)PdCl_4$* | $Mg(NO_3)_2$** | CONCENTRATION OF PCAH RELATIVE TO CONTROL WEIGHT BASIS | IR ANALYSIS*** |
|---|---|---|---|---|
| Control | — | — | 100 | 100 |
| 3 | — | 0.55 | 78 | 78 |
| 4 | 0.06 | 0.55 | 57 | 59 |
| 5 | 0.06 | — | 80 | 78 |

*As palladium
**As nitrate nitrogen
***From infrared spectral absorption in the region of aromatic C—H bonding vibrations. (11.0–14.0)

Once again, the tobacco containing both palladium and magnesium nitrate afforded materially lower PCAH concentrations than those treated with either palladium or magnesium nitrate alone. By comparing the data for Samples 1 and 4, it can be seen that ammonium hexachloropalladate gave lower PCAH levels than the corresponding tetrachloropalladate.

EXAMPLE III

A 1.0-gram portion of ammonium hexachloropalladate was dissolved in 100 cc of water and added to 56.6-grams of sugar-glycerine-propylene glycol casing solution. A 27.84-gram portion of hydrated aluminum nitrate, $Al(NO_3)_3.9H_2O$, was dissolved in the casing solution and the mixture sprayed onto 400 grams of a cut tobacco strip blend (32 cuts per inch), (Sample 6). The final tobacco blend contained 0.06 percent by weight palladium and 0.65 percent by weight added nitrate nitrogen and 0.75 percent by weight total nitrate nitrogen. A blend containing only the $Al(NO_3)_3.9H_2O$ was prepared in a similar manner, (Sample 7).

These samples were tested as described in Example I, and the data obtained are tabulated with Examples IV—VI for a typical run. Data for Sample 2 and the Control of Example I are included for purposes of comparison.

EXAMPLE IV

The same equipment, procedure and materials used in Example III were used in Example IV, except a 22.56-gram portion of potassium nitrate was used in place of the $Al(NO_3)_3.9H_2O$. The final tobacco blend (Sample 8) contained 0.06 percent by weight palladium, 0.65 percent by weight added nitrate nitrogen and 0.75 percent by weight total nitrate nitrogen. A blend containing only the potassium nitrate was prepared in a similar manner, (Sample 9).

These samples were tested as described in Example I, and the data obtained are tabulated with Example III, V and VI for a typical run. Data for Sample 2 and the Control of Example I are included for purposes of comparison.

EXAMPLE V

The same equipment, procedure, tobacco blend and materials used in Example IV were used in Example V except ferric nitrate was used in place of the $Al(NO_3)_3.9H_2O$ in Example IV in an amount sufficient to yield a final tobacco blend (Sample 10) containing 0.05 percent by weight palladium and 0.75 percent by weight nitrate nitrogen of which 0.65 percent of the nitrate nitrogen was provided by the added ferric nitrate. A blend (Sample 11) containing only the ferric nitrate was prepared in a similar manner.

EXAMPLE VI

The same equipment, procedure, tobacco blend and materials used in Example V were used in Example VI except a proportionate amount of sodium nitrite was used in place of the ferric nitrate to yield a final tobacco blend (Sample 12) containing 0.05 percent by weight palladium and 0.65 percent by weight nitrite nitrogen. The tobacco blend also contained 0.1 percent by weight native nitrate nitrogen. The sodium nitrite and the ammonium hexachloropalladate were added separately because when they were added together the acidic nature of the palladium salt prompted the hydrolysis of the nitrite ion and the subsequent decomposition of the nitrous acid. In all of the other samples the nitrate and the palladium salts were dissolved in a diluted casing solution and applied directly to the tobacco. A tobacco blend (Sample 13) containing only the sodium nitrite was prepared in a similar manner.

Samples 6 through 13 of Examples III through IV were tested as described in Example I and are tabulated in Table A.

TABLE A

PYROLYSIS RESULTS OF TOBACCO BLEND[1] EXAMPLES III-VI

| SAMPLE | ADDITIVE[2],[3] | CONCENTRATION OF PCAH RELATIVE TO CONTROL WEIGHT BASIS | IR ANALYSIS[4] |
|---|---|---|---|
| — | Control | 100 | 100 |
| 2 | Palladium (Pd) | 60 | 59 |
| 6 | $Al(NO_3)_3$ | 77 | 62 |
| 7 | $Al(NO_3)_3$ + Pd | 64 | 58 |
| 8 | $KNO_3$ | 70 | 68 |
| 9 | $KNO_3$ + Pd | 63 | 52 |
| 10 | $NaNO_2$ | 85 | 80 |
| 11 | $NaNO_2$ + Pd | 45 | 37 |
| 12 | $Fe(NO_3)_3$ | 84 | 78 |
| 13 | $FE(NO_3)_3$ + Pd | 53 | 46 |

NOTE:
[1]Bright/burley/Maryland/Turkish tobacco strip blend used in all samples. Blend contained 0.1% native nitrate nitrogen.
[2]Nitrates added in amounts equivalent to 0.65% nitrate nitrogen.
[3]Pd though added at levels of 0.06% in the form of $(NH_4)_2PdCl_6$ was found to be present in the final blend at levels of 0.05%
[4]From infrared spectral absorption in the region of aromatic C—H bonding vibrations. (11.9–14.0 μ). The infrared analysis is believed to be the more accurate measurement of the concentration of PCAH.

EXAMPLE VII

The same equipment, procedure and materials used in Example I were used except the final tobacco blend contained 0.12 percent by weight palladium (added as $(NH_4)_2PdCl_6$) and 0.75 percent by weight nitrate nitrogen (0.65 percent of which was provided by added magnesium nitrate hexahydrate). This sample, Sample 14, was tested as described in Example I and showed a relative concentration of PCAH of 42 on a weight basis and 46 based on infrared analysis, compared to a value of 100 for the control of Example I.

EXAMPLE VIII

A blend of Bright, Burley, Maryland and Turkish tobaccos containing 0.1 percent by weight native nitrate was prepared in accordance with conventional procedures and tested in accordance with the pyrolysis procedure of EXAMPLE I.

The results of the pyrolysis test of Example VIII has been tabulated for ease of comparison with the results of Examples IX through XII in Table B.

EXAMPLE IX

The same equipment, materials and procedure used in Example II were used in Example IX except that sufficient ammonium hexachloropalladate and magnesium nitrate hexahydrate were added to 400 g of the cut strip tobacco blend of Example VIII to give a concentration of 0.06 percent by weight metallic palladium and 0.4 percent by weight of added nitrate nitrogen in the final blend.

EXAMPLE X

The same equipment, materials, tobacco blend and procedure used in Example IX were used in Example X except sufficient magnesium nitrate hexahydrate was added to the 400 g blend of tobacco's from Example VIII to give a concentration of added nitrate nitrogen of 0.65 percent by weight of the final blend.

EXAMPLE XI

The same equipment, materials and procedure used in Example VIII were used in Example XI except the concentration of burley tobacco in the final blend was adjusted to yield a native nitrate concentration of 0.5 percent nitrate nitrogen in the final blend.

EXAMPLE XII

The same equipment, materials and procedure used in Example XI were used in Example XII except the sole tobacco used was burley tobacco having a native nitrate concentration of 0.78 percent by weight nitrate nitrogen.

The samples of Examples VIII through XII were pyrolyzed by the same method and procedure described in Example I. The results of these tests are reported in Table B.

The relative values given for the precent reduction of PCAH for all of the foregoing examples were obtained by dividing the experimental values obtained by the following procedures by the value obtained for the control. This result is then multiplied by 100 to give the value listed in the Table.

TABLE B

| EXAMPLE | PALLADIUM WT. %(1) | NATIVE NITRATE NITROGEN WT. % | ADDED NITRATE NITROGEN WT. %2 | CONCENTRATION OF PCAH RELATIVE TO CONTROL, IR ANALYSIS(3) |
|---|---|---|---|---|
| VIII | — | .1 | — | 100 |
| IX | .06 | .1 | .4 | 58 |
| X | .06 | .1 | .65 | 50 |
| XI | .06 | .5 | — | 43 |
| XII | .06 | .78 | — | 35 |

(1)Added as $(NH_4)_2PdCl_6$
(2)Added as $MgNO_3\ 6H_2O$
(3)From infrared spectral absorption in the region of aromatic C—H bonding vibrations. (11.9-14 μ). The infrared analysis is believed to be the more accurate measurement of the concentration of PCAH.

RELATIVE PCAH REDUCTION ON WEIGHT BASIS

This represents the fraction of the gross polycyclic aromatic hydrocarbons (PCAH) in the total dry solids of the smoke condensate. The PCAH gross fraction is obtained by liquid column chromatography using two separate extractions. The first extraction uses alumina as the absorbent and the second uses silica gel as the absorbent.

RELATIVE PCAH REDUCTION ON INFRARED ANALYSIS BASIS

First, a value is obtained which gives you the estimated dosage to cause 50 percent of the sebaceous glands of four white albino test mice to cease functioning. An estimated value is obtained by measuring an infrared absorbance value; this value is then extrapolated by a pre-calibrated curve to give the predicted specific activity which is the weight of PCAH required to cause 50 percent of the sebaceous glands of the mice to cease functioning. The specific activity value is then divided into the total gross PCAH fraction to give a total $ED_{50}$ ($PED_{50}$) value. This $PED_{50}$ value is then divided by the total dry solids fraction of the smoke condensate.

Other conventional tobacco additive materials, such as flavorants and humectants, in addition to those described above may be used in the practice of the present invention without deviating from the scope thereof. However, certain experimental results have shown that the addition of long chain fatty acids in relatively large amount (about 4% by weight) to the tobacco is not beneficial in the practice of the present invention. Employing procedures similar to those described in the Biological Test described in U.S. Pat. No. 4,055,191, cigarette tobacco was treated with casings including palladium. The tobaccos employed had varying natural nitrate contents, and in some instances the casings also contained added magnesium nitrate. The tobacco samples were then employed to prepare sample cigarettes which then were smoked on the wheel-type smoker to collect smoke condensate used for mouse-painting tests. For each tobacco sample, the incidence of tumor-bearing mice, as a percentage of the total mice employed in the test, was determined after necropsy at the end of 80 weeks. In addition, the nitrate content (native nitrate and added nitrate) and the palladium content (total and non-extractable) were determined. Finally, the yield of polycyclic aromatic hydrocarbons in the dry smoke of the cigarettes and of the tobacco on pyrolysis was determined. The data reported as Samples XIII through XVII and Controls A and B, are summarized in Table C.

The reduction of PCAH of the tobacco smoke of the Samples in Table C which contained high native nitrate concentrations was greater when measured by the pyrolysis method reported for the earlier examples than the data obtained by smoking cigarettes prepared from this same tobacco on wheel-type smokers. The reason for this observed difference is not known but the data obtained from the cigarettes smoked on the wheel-type smoker is believed to be the more credible. This difference was not observed in those instances where the nitrate nitrogen was added to the tobacco as an inorganic salt but only in those samples containing relatively high native nitrate concentrations (greater than 0.5%).

TABLE C

| SAMPLE | CONTROL A | XIII | CONTROL B | XIV | XV | XVI | XVII |
|---|---|---|---|---|---|---|---|
| Tobacco Blend, wt. % | | | | | | | |
| Strips | 84 | 74 | 60 | 65 | 60 | 60 | 60 |

TABLE C-continued

| SAMPLE | CONTROL A | XIII | CONTROL B | XIV | XV | XVI | XVII |
|---|---|---|---|---|---|---|---|
| SNR[1] | 11 | 21 | 20 | 17 | 20 | — | — |
| Stems | 5 | 5 | 12 | 10 | 12 | 5 | 5 |
| SCT[2] | — | — | 8 | 8 | 8 | 8 | 8 |
| BSL[3] | — | — | — | — | — | 27 | 27 |
| Total Palladium,[6] ppm of Blend | — | 550 | — | 580 | 580 | 660 | 820 |
| Extractable Pall-[6] adium; ppm | — | 360 | — | 500 | 440 | 480 | 610 |
| Non-Extractable[6] Palladium, ppm | — | 190 | — | 80 | 140 | 180 | 210 |
| Native Nitrate Nitrogen, wt. % | 0.21 | 0.30 | 0.55 | 0.47 | 0.59 | 0.69 | 0.80 |
| Added Nitrate Nitrogen, wt. % | — | 0.44 | — | — | — | — | — |
| Native Magnesium, wt. % | 0.5 | 0.5 | 0.5 | 0.5 | 0.5 | 0.5 | 0.5 |
| Added Magnesium,[4] wt. % | — | 0.45 | — | — | — | 0.42 | — |
| Casing Formula,[7] wt. % | | | | | | | |
| Invert Sugar | 25.6 | 7.9 | 21.8 | 9.9 | 9.9 | 14.0 | 14.0 |
| Corn Syrup | 8.4 | 2.6 | 6.6 | 3.0 | 3.0 | 3.5 | 3.5 |
| Glycerine | 13.2 | 4.1 | 14.5 | 6.6 | 6.6 | 7.3 | 7.3 |
| Propylene Glycol | 4.6 | 1.4 | 11.4 | 5.2 | 5.2 | 5.9 | 5.9 |
| Flavor | 9.2 | 2.9 | 7.8 | 3.5 | 3.5 | 4.0 | 4.0 |
| Lactic Acid | 0.5 | 0.2 | — | — | — | — | — |
| $H_2O$ | 38.5 | 61.4 | 37.9 | 70.8 | 70.8 | 63.9 | 63.9 |
| $Mg(NO_3)_2 \cdot 6H_2O$ | — | 18.7 | — | — | — | — | — |
| $(NH_4)_2PdCl_6$ | 00 | 0.8 | — | 1.0 | 1.0 | 1.0 | 1.4 |
| PCAH Reduction, % of Control | | | | | | | |
| Pyrolysis | 100 | 58 | 69 | 59 | 45 | 39 | 41 |
| Cigarette Smoke | 100 | 53 | 93 | 67 | 55 | 55 | 45 |
| Biological Response | | | | | | | |
| % of Animals w/ Papillomas | 46.7 | 2.3 | 41 | 32.6 | 43.8[5] | 22 | 25 |
| % of Control | 100 | 4.9 | 87.8 | 69.8 | 56.3 | 47.1 | 53.5 |
| % of Animals w/Carcinomas | 20.7 | 0.0 | 8.7 | 10.9 | 6.3 | 0.0 | 4.2 |

Footnotes for Table C

[1]SNR = reconstituted tobacco sheet

[2]SCT = special cut tobacco (expanded tobacco)

[3]BSL = rolled burley stems

[4]the magnesium was added as a 50/50 weight mixture of magnesium acetate and magnesium maleate

[5]at the 74-week point the animals in this group exhibited an anomalous change in the biological response as reflected in the high number of papilloma observed. When the data for the period preceding this 74-week period are extrapolated to the final 80 weeks a result of 22.5% of animals tested developed papillomas as compared with the observed result of 43.8%

[6]Determination of "Extractable Palladium" From Tobacco

An accurately weighed sample of tobacco weighing from about 1 to about 2 grams is mixed with 50 ml of an ammoniacal solution of ethylenediamine tetraacetic acid (EDTA) (0.1 M in) EDTA and 1 M in $NH_4$ The having a pH of about 10. The resulting mixture is continuously agitated for 30 minutes, and is immediately filtered through a membrane An having pore size of not greater than 0.45 microns. A 10.0 ml portion of the filtrate is evaporated to dryness in a 100-ml beaker and 5 to 10 ml of 1:1 reagent grade nitric acid and reagent grade perchloric acid is added to the residue. The beaker is covered with a cover glass and heated on an electrical hot plate at a moderate rate for at least 2 hours after the appearance of $HClO_4$ fumes, the cover is then removed and heating is continued to evaporate the sample to dryness. The beaker is cooled to ambient temperature, 1 ml of concentrated reagent grade hydrochloric acid is added, the cover is replaced and the mixture is heated to boiling. Then 10 ml of water are added to the residue and the mixture is digested by heating near boiling (80–100° C.) for 10 minutes. The solution is then cooled to room temperature and diluted to 25 ml with water to form a sample to be subjected to analysis for palladium.

Analysis for Non-Extractable Palladium in Tobacco The "non-extractable" palladium is determined by subtracting the extractable palladium from total palladium.

Determination of "Total Palladium" In Tobacco An accurately weighed sample of about 1 gram of tobacco is placed in a 100-ml beaker, 5 to 10 ml of 1:1 reagent grade nitric acid and reagent grade perchloric acid is added, the beaker is covered with a cover glass and heated on an electrical hot plate at a moderate rate for at least 2 hours. The cover is then removed, and heating is continued to evaporate the sample to dryness. The beaker is then cooled to ambient temperature, 1 ml of reagent grade concentrated hydrochloric acid is added, and the cover is replaced. The mixture is heated to boiling momentarily, 10 ml of 0.1 N nitric acid is added, and the solution is digested by heating near boiling (80–100° C.) for 10 minutes. The solution is cooled to ambient temperature, and diluted with 0.1 N nitric acid to 25 ml to form an analytical sample.

[7]The casing application rates were as follows for each of the examples in Table C (rate = pounds of total casing per 100 pounds of total tobacco)

| Control A | XIII | Control B | XIV | XV | XVI | XVII |
|---|---|---|---|---|---|---|
| 11.9 | 33.7 | 12.4 | 24.8 | 24.8 | 24.1 | 24.1 |

Any references herein to a reduced biological activity of the tobacco smoke of the claimed compositions are based solely on the results obtained from experimental animal testing procedures following conventional protocol, such as set forth hereinabove.

The disclosures of parent applications, Ser. No. 721,142, filed Sep. 7, 1976 and Ser. No. 458,355, filed Apr. 5, 1974 is incorporated here by reference these patent applications now being abandoned.

While the invention has been described in detail with particular reference to preferred embodiments thereof, it will be understood that variations and modifications can be effected within the spirit and scope of the invention as described hereinabove and as defined in the appended claims.

What is claimed is:

1. A smoking composition comprising tobacco containing about 0.25 to about 0.80 weight percent native nitrate nitrogen and palladium in an amount of from about 0.001 to about 1 weight percent based on the weight of the tobacco wherein said palladium is in the form of finely divided metallic palladium.

2. The composition of claim 1 wherein the palladium is present as palladium black.

3. The composition of claim 1 wherein the palladium is in the form of ammonium hexachloropalladate.

* * * * *